US006932193B2

(12) United States Patent
Tombarello

(10) Patent No.: US 6,932,193 B2
(45) Date of Patent: Aug. 23, 2005

(54) BOAT BOW ACCESS LADDER FOR TRAILER

(76) Inventor: George R Tombarello, 63 Providence Hill Rd., Atkinson, NH (US) 03811

( * ) Notice: Subject to any disclaimer, the term of this patent is extended or adjusted under 35 U.S.C. 154(b) by 0 days.

(21) Appl. No.: 10/646,327

(22) Filed: Aug. 22, 2003

(65) Prior Publication Data

US 2005/0039983 A1 Feb. 24, 2005

(51) Int. Cl.[7] ..... E04G 3/00; E06C 5/00; B63B 17/00

(52) U.S. Cl. ..... 182/93; 182/127; 114/362

(58) Field of Search ..... 182/129, 93, 194, 182/127, 92; 114/362

(56) References Cited

U.S. PATENT DOCUMENTS

| | | | | |
|---|---|---|---|---|
| 3,606,934 A | | 9/1971 | Johansen | 182/97 |
| 4,146,941 A | | 4/1979 | Haslam | 9/1.6 |
| 4,153,137 A | | 5/1979 | Johnson | 182/97 |
| 4,858,725 A | * | 8/1989 | Griffin | 182/127 |
| 4,909,352 A | * | 3/1990 | McComb | 182/127 |
| 5,042,614 A | * | 8/1991 | Rainey | 182/127 |
| 5,123,372 A | | 6/1992 | Kobayashi et al. | 114/362 |
| 5,692,581 A | * | 12/1997 | Nelson et al. | 182/194 |
| 5,896,946 A | | 4/1999 | Brackett | 182/93 |
| 6,145,621 A | | 11/2000 | Nye | 182/159 |
| 6,357,548 B1 | * | 3/2002 | Boyd | 182/127 |
| 6,378,654 B1 | * | 4/2002 | Ziaylek et al. | 182/97 |
| 6,622,822 B1 | * | 9/2003 | Langhoff et al. | 182/90 |

* cited by examiner

*Primary Examiner*—Hugh B. Thompson, II
(74) *Attorney, Agent, or Firm*—Pearson & Pearson, LLP

(57) ABSTRACT

A boat ladder attached to a trailer for easy access to a bow of a boat. The ladder comprises two side rails with spaced-apart steps or rungs between the side rails, the lower portion of one of the side rails curving a predetermined distance toward the other side rail and then running parallel with the other side rail wherein the lower ends of the ladder side rails fit into bases secured to a front longitudinal member of the trailer. The bases are secured on each side of the longitudinal member of the trailer, and the lower ends of the side rails fit into cylindrical tubes attached to the sides of the base.

11 Claims, 3 Drawing Sheets

BOAT BOW ACCESS LADDER FOR TRAILER

BACKGROUND OF THE INVENTION

1. Field of the Invention

This invention relates generally to ladders for climbing onto a boat and in particular to a ladder that quickly attaches to a base mounted on a boat trailer and provides access to a bow of the boat.

2. Description of Related Art

Boat trailers generally have a frame that is Y-shaped at the front end having a tongue for mounting on a hitch attached to the rear of a vehicle, and a winch post mounted on a longitudinal member of the Y-shaped frame front end.

When a boat is being launched and the boat and trailer are backed into water, accessibility to the boat is restricted and usually not very easy to accomplish especially when there is no dock. Generally, boat ladders are for access to a boat when it is in the water. However, it is often necessary to climb onto the bow of the boat either before launch or after loading the boat back onto the trailer. It is common to stand on the trailer near the winch, but it is difficult to get onto the bow or nose platform from the trailer without climbing on a ladder.

In U.S. Pat. No. 4,146,941, issued Apr. 3, 1979 to Ivan S. Haslam, discloses a boat bow ladder assembly comprising a mounting bracket and a ladder portion. The ladder portion includes a plurality of exposed rungs disposed at least during use in a substantially vertical orientation. The mounting bracket attaches to the bow of the boat by means of an existing eye used to connect the bow of the boat to a trailer.

U.S. Pat. No. 5,896,946, issued Apr. 27, 1999 to Wesley E. Brackett, discloses a boarding ladder and winch mount system for a boat trailer. A front member mounts on a frame of the trailer; a top member mounts a winch for drawing a boat onto the trailer. A step subassembly mounts to a stringer member and crossbar and the rungs have an accurate shape extending approximately ninety degrees from the front member to the stringer member. It is particularly useful for climbing onto the deck of a pontoon boat when it is loaded on a trailer.

U.S. Pat. No. 5,123,372, issued Jun. 23, 1992 to Noboru Kobayashi et al., and assigned to Yamaha et al., discloses a ladder which is stowed within a recessed area on a bow of a boat and it is moveable over the tip of the bow to extend from the boat to a landing area in order to assist in boarding or alighting a boat or other similar watercraft. It is particularly useful when a boat is beached bow first. It does not attach to a trailer and could present safety issues if used when a boat is on a trailer.

U.S. Pat. No. 6,145,621, issued Nov. 14, 2000, to John E. Nye, discloses a foldable boarding ladder for a boat bow. This ladder is suitable for boarding the bow end of a boat which has been beached bow first, and when the ladder is not in use it can be folded to a size convenient for compact storage.

SUMMARY OF THE INVENTION

Accordingly, it is therefore an object of this invention to provide a ladder that readily attaches to a boat trailer and provides access to a bow of a boat.

It is another object of this invention to provide a ladder base that attaches to the front end of a boat trailer, and has receptacle sides for insertion of the legs of the ladder.

It is another object of this invention to provide a boat bow access ladder having a lower portion wherein a first side rail curves a predetermined distance toward a second side rail and then continues parallel to said second side rail for insertion into the ladder base.

It is a further object of this invention to provide a ladder that is easily set-up and removed from a boat trailer.

It is another object of this invention to provide ladder rungs that are slip-resistance by attaching anti-slip material to the upper surface of the rungs.

These and other objects are accomplished by a boat bow access ladder comprising means attached to a trailer for holding the ladder, the ladder having side rails and a plurality of steps, the side rails being inserted into the holding means secured to a trailer for providing access to a bow of a boat. A first one of the side rails curves a predetermined distance toward a second of the side rails then proceeds parallel to the second of the side rails for insertion into the holding means. The holding means comprises a pair of receptacles secured on opposite sides of the holding means for receiving the side rails of the ladder. The holding means comprises cylindrical tubes. Each of the steps comprise a slip resistant material adhered to an upper surface of the steps.

The objects are further accomplished by a boat bow access ladder comprising means attached to a trailer for receiving ladder side rails, and a ladder having a plurality of rungs positioned between the side rails wherein an end portion of a first side rail curves toward a second side rail a predetermined distance until the first side rail and the second side rail are parallel and insertable into the receiving means. The receiving means comprises receptacles secured on opposite sides of the receiving means. The receptacles comprise cylindrical tubes. The receiving means comprises an inverted U-shaped base having a receptacle attached to each side of the base. Each of the rungs comprises a slip resistant material adhered to an upper surface of the rungs.

Additional objects, features and advantages of the invention will become apparent to those skilled in the art upon consideration of the following detailed description of the preferred embodiments exemplifying the best mode of carrying out the invention as presently perceived

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
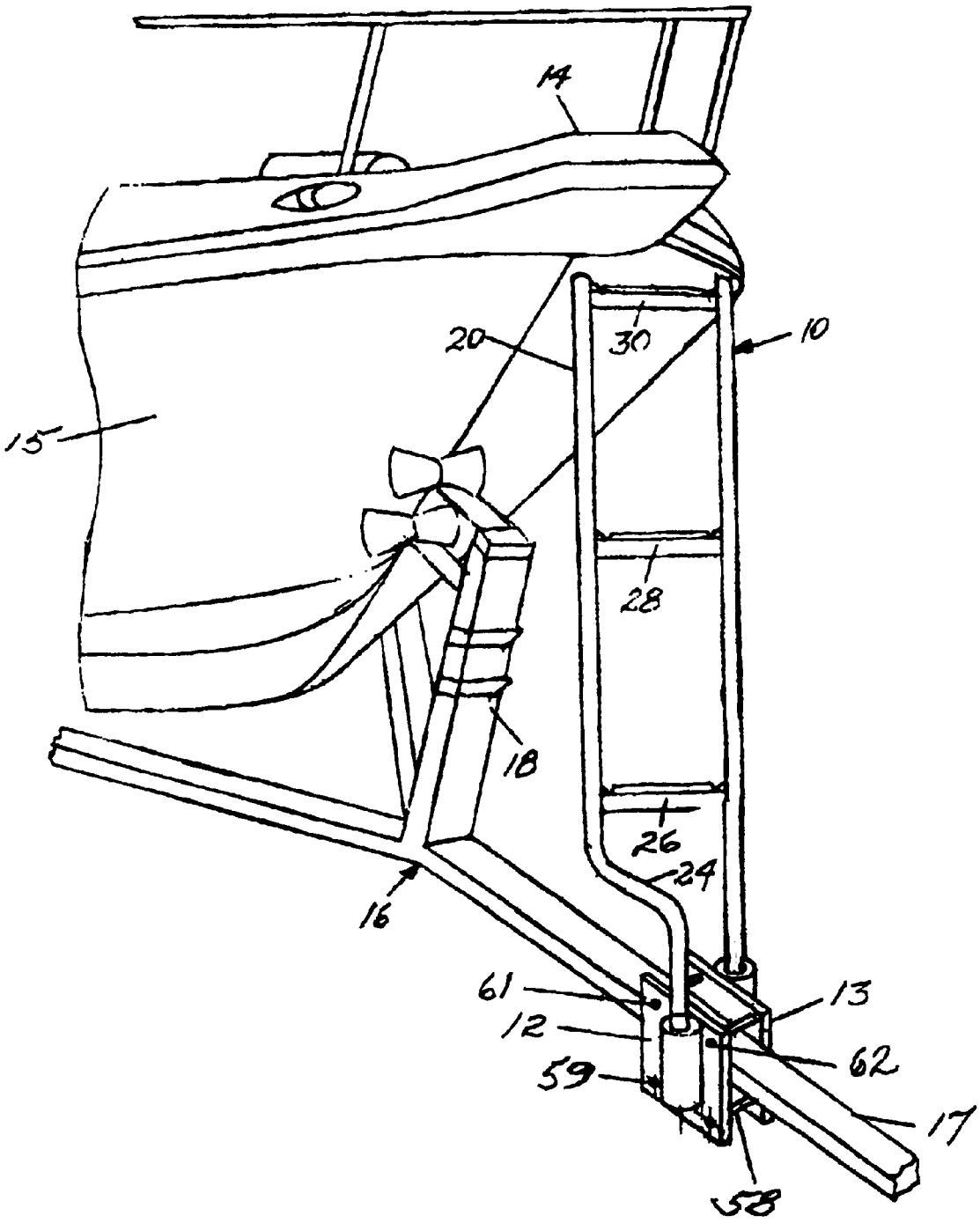
FIG. 1 is a perspective view of a boat bow access ladder and base according to the invention, attached to a boat trailer and positioned near the bow of a boat.
Figure 2:
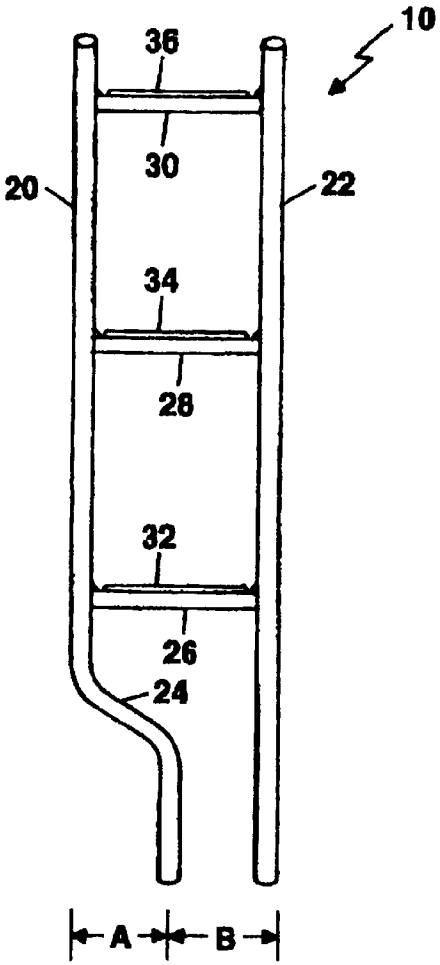
FIG. 2 is a front elevational view of the boat bow access ladder according to the invention.

Referring to FIG. 1 and FIG. 2, a perspective view of a boat bow access ladder 10 according to the invention is shown. The ladder 10 is attached to a boat trailer 16 and positioned near the bow area 14 of a boat 15. FIG. 2 is a front elevational view of the boat bow access ladder 10 according to the invention. The boat bow access ladder 10 is particularly useful when the boat 15 and trailer 16 are on a loading ramp and the accessibility to the boat 15 is restricted because of the submerged position of the boat 15 and the trailer 16 under the boat's stern. The boat bow access ladder 10 is inserted into base plates 12 and 13 which attach to each side of longitudinal member 17 of the trailer 16.

The ladder 10 comprises side rails 20, 22 and a plurality of steps or rungs 26, 28, 30 which are welded between the side rails 20, 22. The lower portion 24 of side rail 20 below rung 26 curves inward a predetermined distance A from side rail 20 toward side rail 22 and then runs parallel to side rail 22 again at a predetermined distance B. The predetermined distance B is determined by the width of the base 12 into which the ladder 10 mounts. In the present embodiment the lower end of side rail 20 curves to a point midway across the width of the step 26. The side rails 20, 22 and the steps or rungs 26, 28, 30 may be embodied with tubular aluminum although other known materials such as plastic may also be used to implement the ladder 10. A one inch wide strip of non-skid material 32, 34, 36 is applied to the upper surface of each rung 26, 28, 30 to make the ladder safer to use when it is wet. The non-skid material may be embodied by a safety slip-resistance material made by 3M.

Figure 3:
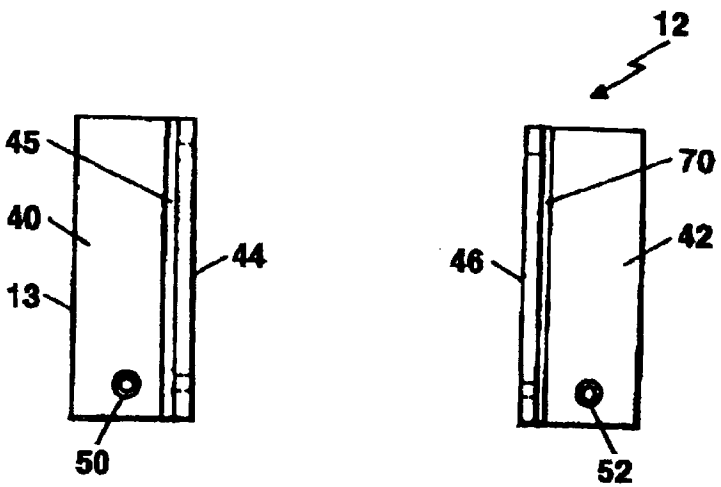
FIG. 3 is a side elevational view of each base of the invention for mounting the boat bow access ladder.

Referring now to FIG. 3, a front elevational view of each base 12 and 13 is shown for mounting the boat bow access ladder 10 on the trailer 16. Each base 12 and 13 comprises an elongated base plates 45 and 70 and two side sections 44, 46 forming an inverted U-shape bracket or bases 12 and 13 for mounting on the trailer 16. A first receptacle or hollow cylindrical tube 40 is attached to the side section 44 and a second receptacle or hollow cylindrical tube 42 is attached to the side section 46. Cylindrical-shaped stop pins 50, 52 are inserted through ⅛ inch holes in the side of the cylindrical tubes 40, 42 near the lower end of the cylindrical tubes 40, 42 for stopping the ends of the ladder side rails 20, 22, when inserted into the base cylindrical tubes 40, 42, from protruding from the bottom of the bases 12 and 13. The stop pins 50, 52 may be stainless steel or aluminum. The base sections 44, 46 may be embodied with ½ inch×4 inch aluminum, and the base cylindrical tubes 40, 42 may be embodied by 1–½ inch. The cylindrical tubes 40, 42 are attached to the side sections 44, 46 by welding.

Figure 4:
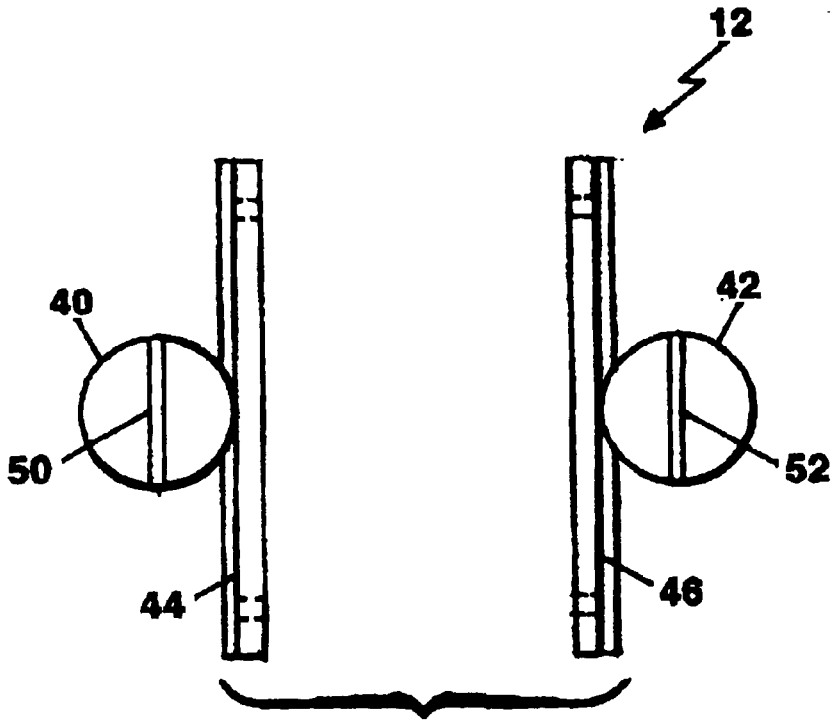
FIG. 4 is a top view of the base for mounting the ladder.

Referring to FIG. 4, a top view of the bases 12 and 13 are shown. The cylindrical tubes 40, 42 are attached to base sides 44, 46 respectively, and the stop pins 50, 52 extend across the diameter of the cylindrical tubes 40, 42.

Figure 5:
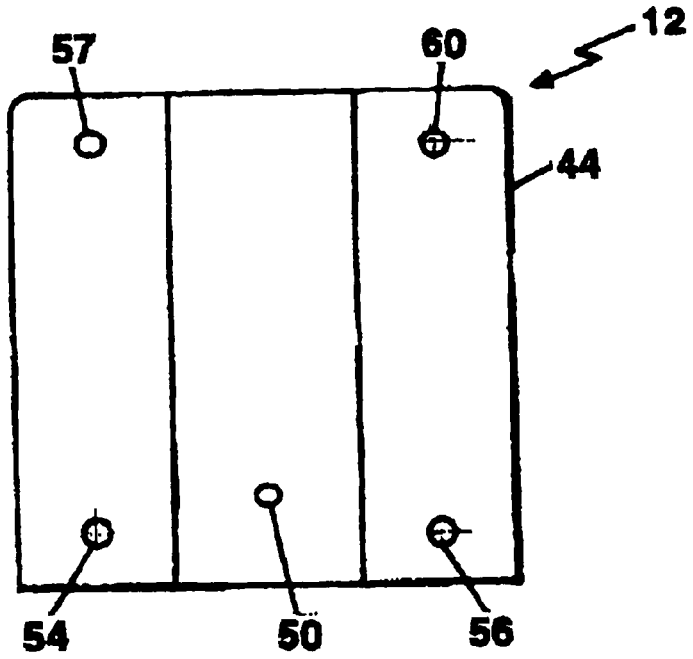
FIG. 5 is a front elevational view of the base with holes for attaching the base to a trailer.

Referring again to FIG. 1 and FIG. 5, FIG. 5 is a side elevational view of each base 12 and 13 showing the cylindrical tubes 40 and 42 attached approximately in the center of side section 44 and 46. FIG. 1 shows a front perspective view of the bases 12 and 13 attached to the longitudinal member 17 of trailer 16. At least 4, ⅜ inch holes 54, 56, 57 and 60 are provided in the lower and upper portion of each of the side sections 44 and 46 for inserting bolts 58, 59 61, and 62 through holes 54, 56, 57 and 60 in order to secure the bases 12 and 13 to the longitudinal member 17 of the trailer 16.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A boat bow access ladder comprising:

means attached to a trailer for holding said ladder;

said ladder having side rails and a plurality of steps, said side rails being inserted into said holding means secured to a trailer for providing access to a bow of a boat; and a first one of said side rails curves a predetermined distance toward a second of said side rails and then proceeds parallel to said second of said side rails for insertion into said holding means.

2. The boat bow access ladder as recited in claim 1 wherein said holding means comprises a pair of receptacles secured on opposite sides of said holding means for receiving said side rails of said ladder.

3. The boat bow access ladder as recited in claim 2 wherein said receptacles comprise cylindrical tubes.

4. The boat bow access ladder as recited in claim 1 wherein each of said steps comprise a slip resistant material adhered to an upper surface of said steps.

5. A boat bow access ladder comprising:

means attached to a trailer for receiving side rails of said ladder; and said ladder having a plurality of rungs positioned between said side rails wherein an end portion of a first side rail curves toward a second side rail a predetermined distance until said first side rail and said second side rail are parallel and insertable into said receiving means.

6. The boat bow access ladder as recited in claim 5 wherein said receiving means comprises receptacles secured on opposite sides of said receiving means.

7. The boat bow access ladder as recited in claim 6 wherein said receptacles comprise cylindrical tubes.

8. The boat bow access ladder as recited in claim 5 wherein said receiving means comprises an inverted U-shaped base having a receptacle attached to each side of said base.

9. The boat bow access ladder as recited in claim 5 wherein each of said rungs comprise a slip resistant material adhered to an upper surface of said rungs.

10. A method of providing access to a bow of a boat when on a trailer comprising the steps of:

attaching a base on a trailer at a location near the bow of said boat;

inserting side rails of a ladder into said base, said ladder having a plurality of rungs positioned between said side rails; and curving a first one of said side rails a predetermined distance toward a second one of said side rails until said first one and said second one of said side rails are parallel and insertable into said base.

11. The method as recited in claim 10 wherein said method comprises the step of providing receptacles on the side base of said for receiving said side rails.

* * * * *